US006662847B1

(12) United States Patent
Squibb et al.

(10) Patent No.: US 6,662,847 B1
(45) Date of Patent: Dec. 16, 2003

(54) RIDGE FOLD DIVIDER CURTAIN

(75) Inventors: Neal C. Squibb, Scranton, IA (US); Timothy D. Mobley, Jefferson, IA (US); Steven R. Johnson, Paton, IA (US)

(73) Assignee: American Sports International, Jefferson, IA (US)

( * ) Notice: Subject to any disclaimer, the term of this patent is extended or adjusted under 35 U.S.C. 154(b) by 0 days.

(21) Appl. No.: 10/305,888

(22) Filed: Nov. 27, 2002

(51) Int. Cl.[7] ..... E06B 9/06

(52) U.S. Cl. ..... 160/84.01

(58) Field of Search ..... 160/84.01, 84.02, 160/84.04, 84.07, 331, 345, 1, 7; 47/17; 52/63

(56) References Cited

U.S. PATENT DOCUMENTS 3,481,073 A * 12/1969 Yoshida et al. ..... 47/17
3,766,958 A * 10/1973 Mitchell ..... 160/1 X
4,062,146 A * 12/1977 Grossman et al. ..... 47/17
5,197,526 A * 3/1993 Schon ..... 160/84.01
6,170,551 B1 * 1/2001 Henningsson et al. ..... 52/63 X

* cited by examiner

*Primary Examiner*—David Purol

(57) ABSTRACT

The present invention provides a divider curtain for attachment to a non-linear superstructure. The divider curtain includes a screen having an upper end and lower end. The upper end is adapted to engage the non-linear superstructure and to conform to the shape of the non-linear superstructure. The lower end has a straight horizontal edge when the screen is in a lowered position. The lower end is adapted to conform to the shape of the non-linear superstructure when the screen is in a raised position.

15 Claims, 5 Drawing Sheets

54
62
74
64
76
78
66

RIDGE FOLD DIVIDER CURTAIN

BACKGROUND OF THE INVENTION

It is often desired to provide curtains within rooms for dividing the room into more than one section. When the ceiling superstructure of the room has a linear or flat shape the curtain is of a relatively strait forward design.

Often, however, the room will have a ceiling superstructure of non-linear shape, such as a ridge. Conventional curtains when provided for such a room fail to conform to the shape of the ceiling superstructure and are thus not space efficient.

Therefore, a principal object of this invention is to provide a divider curtain having a screen, for conforming to the shape of the superstructure when the screen is in a raised position.

These and other objects will be apparent to those skilled in the art.

SUMMARY OF THE INVENTION

The present invention provides a divider curtain for attachment to a non-linear superstructure. The divider curtain includes a screen having an upper end and lower end. The upper end is adapted to engage the non-linear superstructure and to conform to the shape of the non-linear superstructure. The lower end has a straight horizontal edge when the screen is in a lowered position. The lower end is adapted to conform to the shape of the non-linear superstructure when the screen is in a raised position.

DESCRIPTION OF THE PREFERRED EMBODIMENT

Figure 1:
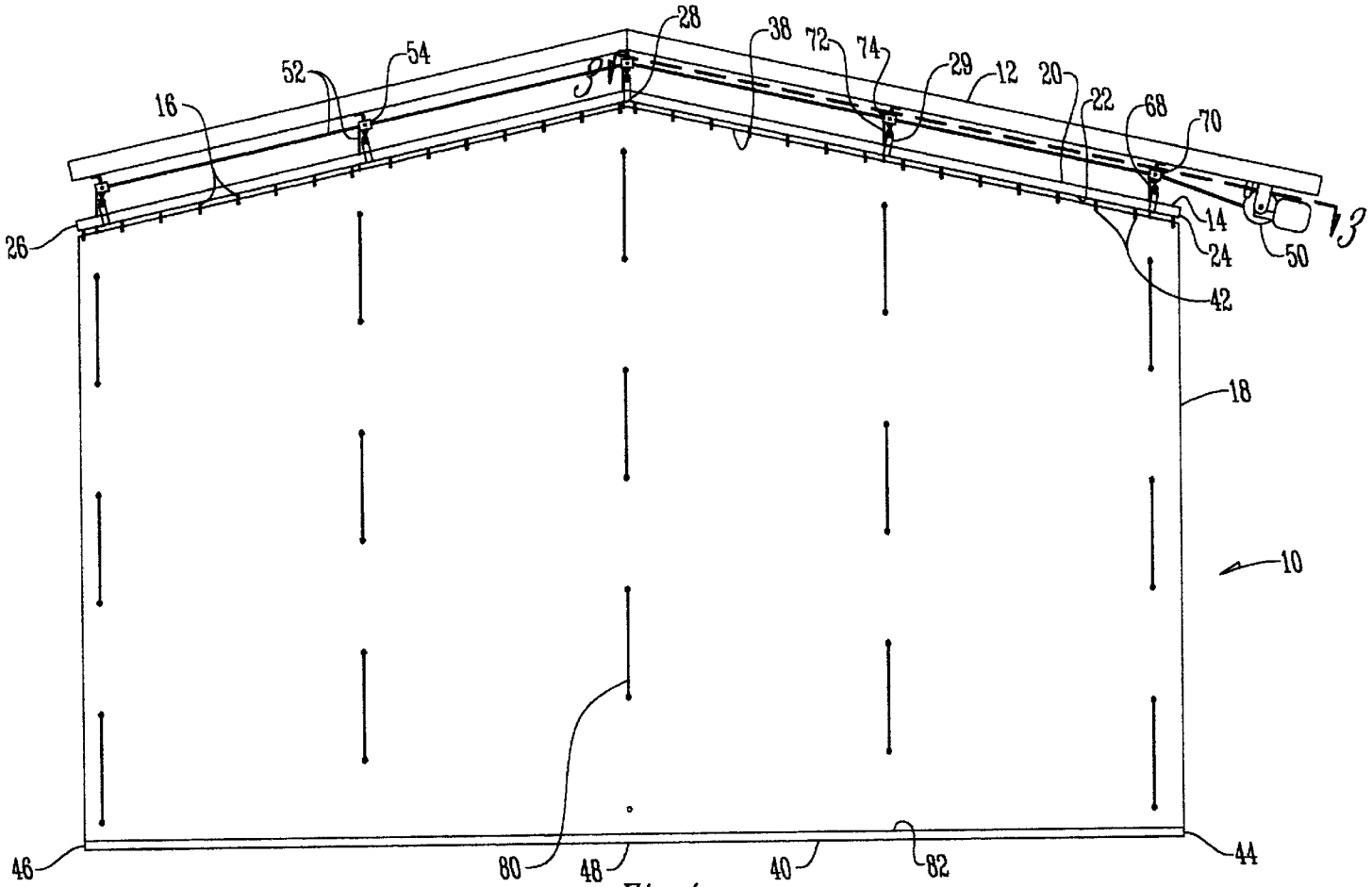
FIG. 1 is a view of the divider curtain of this invention in a fully extended position.

With reference to FIG. 1, the present invention provides a divider curtain 10 for attachment to a non-linear superstructure 12. The non-linear superstructure 12 shown is an inverted V-shaped configuration; however, it will be understood that divider curtain 10 is adaptable to operate with other non-linear superstructure 12 configurations. The divider curtain includes a track 14 adapted to engage the superstructure 12, a plurality of trolleys 16 movably engaged with the track 14, and a screen 18 attached to the trolleys 16. The screen 18 is adapted to conform to the shape of the superstructure 12 when the screen 18 is in a raised position.

The track 14 is adapted to engage the superstructure 12 and to conform to the shape of the superstructure 12. The track 14 has an upper surface 20, a lower surface 22, a proximal end 24, a distal end 26, and a mid point 28 between the proximal and distal ends 24 and 26. The proximal and distal ends 24 and 26 slope downwardly from the mid point 28.

The upper surface 20 is adapted to engage the superstructure 12. For this purpose, a plurality of hangers 29 are provided to attach to the track 14 for engaging the track to the superstructure 12.

Figure 5:
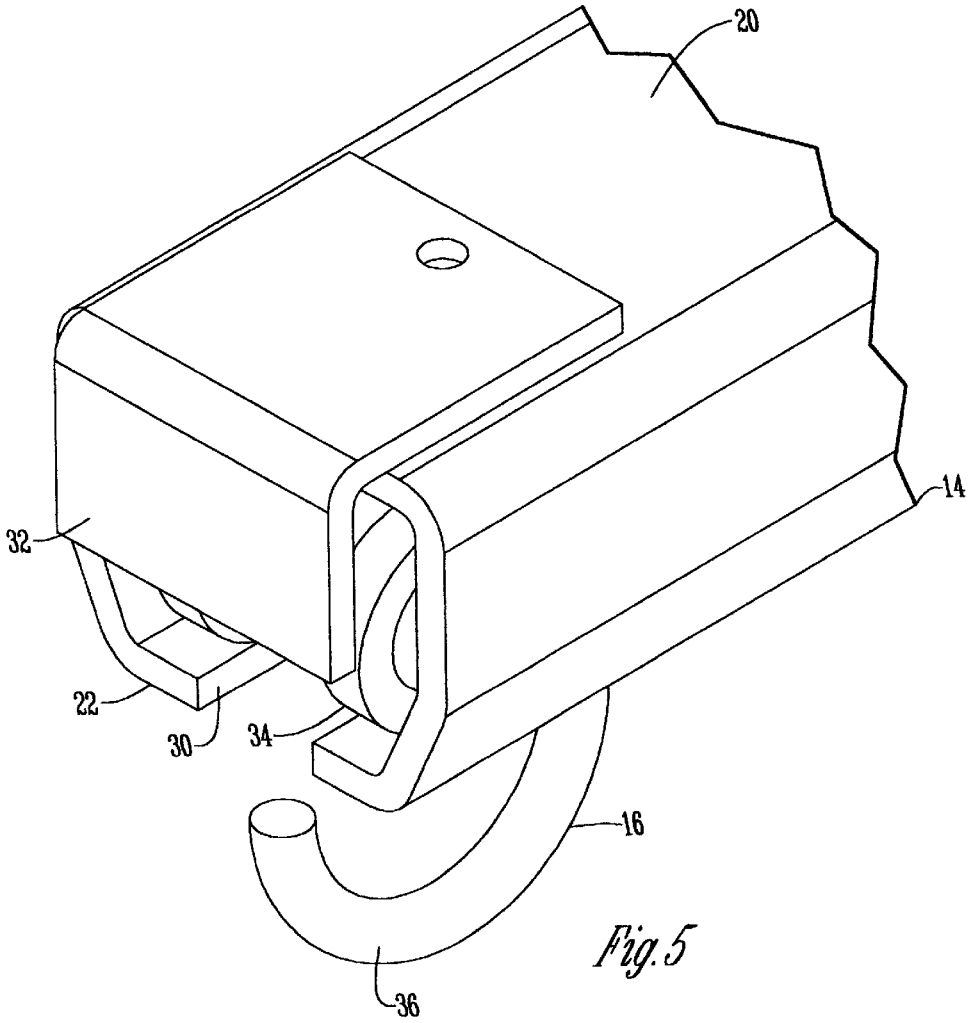
FIG. 5 is a partial perspective view of a track and trolley of the invention.

With reference to FIG. 5, the lower surface 22 has an elongated opening 30 for movably receiving the trolleys 16. An end stop 32 is provided to removably close the proximal and distal ends 24 and 26, and to secure the trolleys 16 within the track 14.

The plurality of trolleys 16 have an upper portion 34 and a lower portion 36. The upper portion 34 is movably engaged with the track 14. The lower portion 36 is a fastener for removably securing the trolley 16 to the screen 18.

Figure 2:
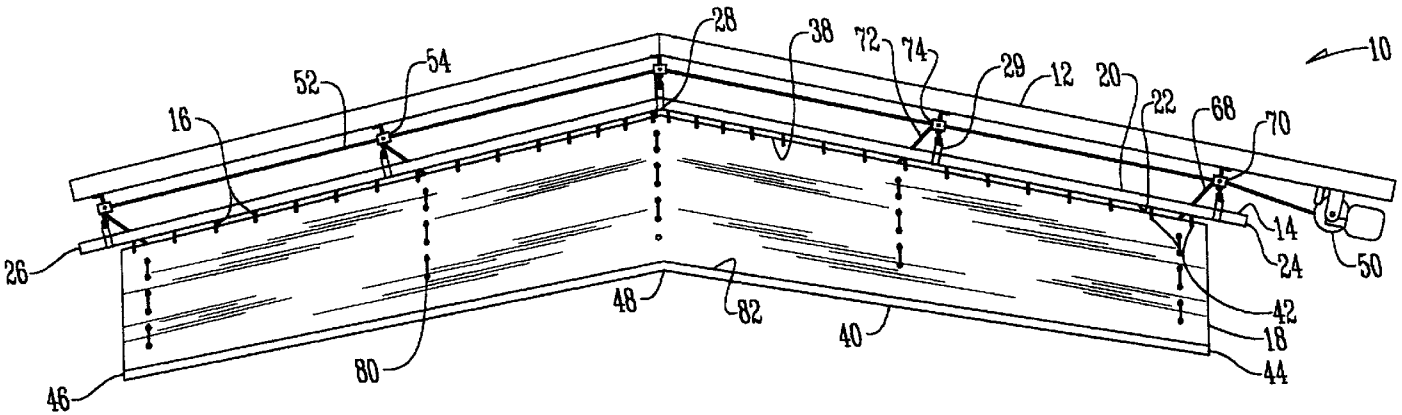
FIG. 2 is a view of the divider curtain of this invention in a fully raised position.

With reference to FIGS. 2 and 5, the trolleys 16 are adapted to move along the track 14 as the screen 18 is raised to allow the screen 18 to contract in a lateral dimension as the screen 18 is raised in a longitudinal dimension.

With reference to FIG. 1, the screen 18 has an upper end 38 and a lower end 40. The upper end 38 is adapted to conform to the shape of the superstructure 12. The upper end 38 is attached to the lower portions 36 of the trolleys 16 by a plurality of top grommets 42 in screen 18.

With reference to FIGS. 1 and 2, the lower end 40 of screen 18 has a straight horizontal edge when the screen 18 is in a lowered position, and is adapted to conform to the shape of the superstructure 12 when the screen 18 is in a raised position.

The lower end 40 of the screen 18 has a proximal tip 44, a distal tip 46, and an inner point 48 between the proximal and distal tips 44 and 46. When the screen 18 is raised, the inner point 48 raises a greater distance than the proximal and distal tips 44 and 46. The trolleys 16 are adapted to move toward the midpoint 28 of the track 14 as the screen 18 is raised, allowing the lower end 40 of the screen 18 to fully compress and conform to the shape of the superstructure 12. Thus, a distance between screen proximal tip 44 and the track lower surface 22, a distance between screen distal tip 46 and the track lower surface 22, and a distance between the screen inner point 48 and the track mid point 28 are all approximately equal when the screen 18 is fully raised.

It will be understood that the screen 18 can be composed of various material with differing physical properties. Where the screen 18 is composed of a stretchable material, the screen 18 will stretch an equal amount in the lateral and longitudinal dimensions when the screen 18 is raised to conform to the shape of the superstructure 12. Where the screen 18 is composed of a non-stretchable material, the screen 18 can still be raised to conform to the shape of the superstructure 12 due to the lateral movement allowed for by the trolleys 16.

Figure 3:
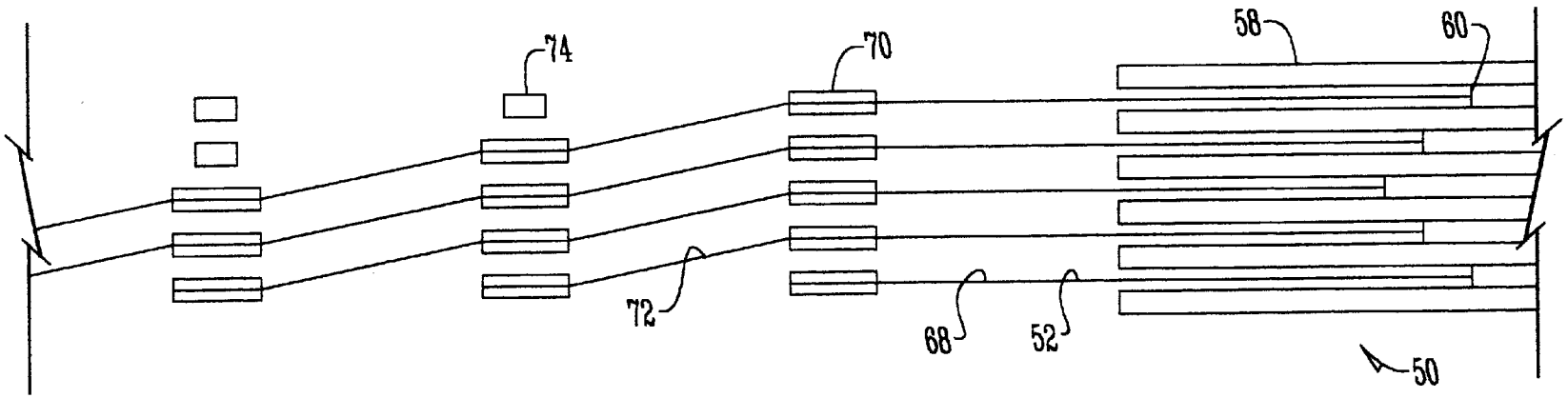
FIG. 3 is a partial schematic view of the device of this invention taken along line 3—3 of FIG. 1.

With reference to FIGS. 1 and 3, the present invention also provides a wench 50, a plurality of cords 52, and a plurality of pulley assemblies 54. The wench 50 is operatively associated with the screen 18 to raise and lower the screen 18. The plurality of cords 52 are operatively associated between the screen 18 and the wench 50, so that the cords raise the screen 18 when the wench 50 is activated. The plurality of pulley assemblies 54 engage upper surface 20 of the track 18 to the superstructure 12 and direct the movement of the cords 52 between the screen 18 and the wench 50.

The wench 50 includes a drum assembly 58 having a plurality of drum brackets 60 of varying size. A single cord 52 is associated with a single drum bracket 60. The drum brackets 60 are sized so that a cord 52 that raises the greatest distance is associated with a drum bracket 60 of the greatest diameter, while a cord 52 that raises the least distance is associated with a drum bracket 60 of the least diameter.

Figure 4:
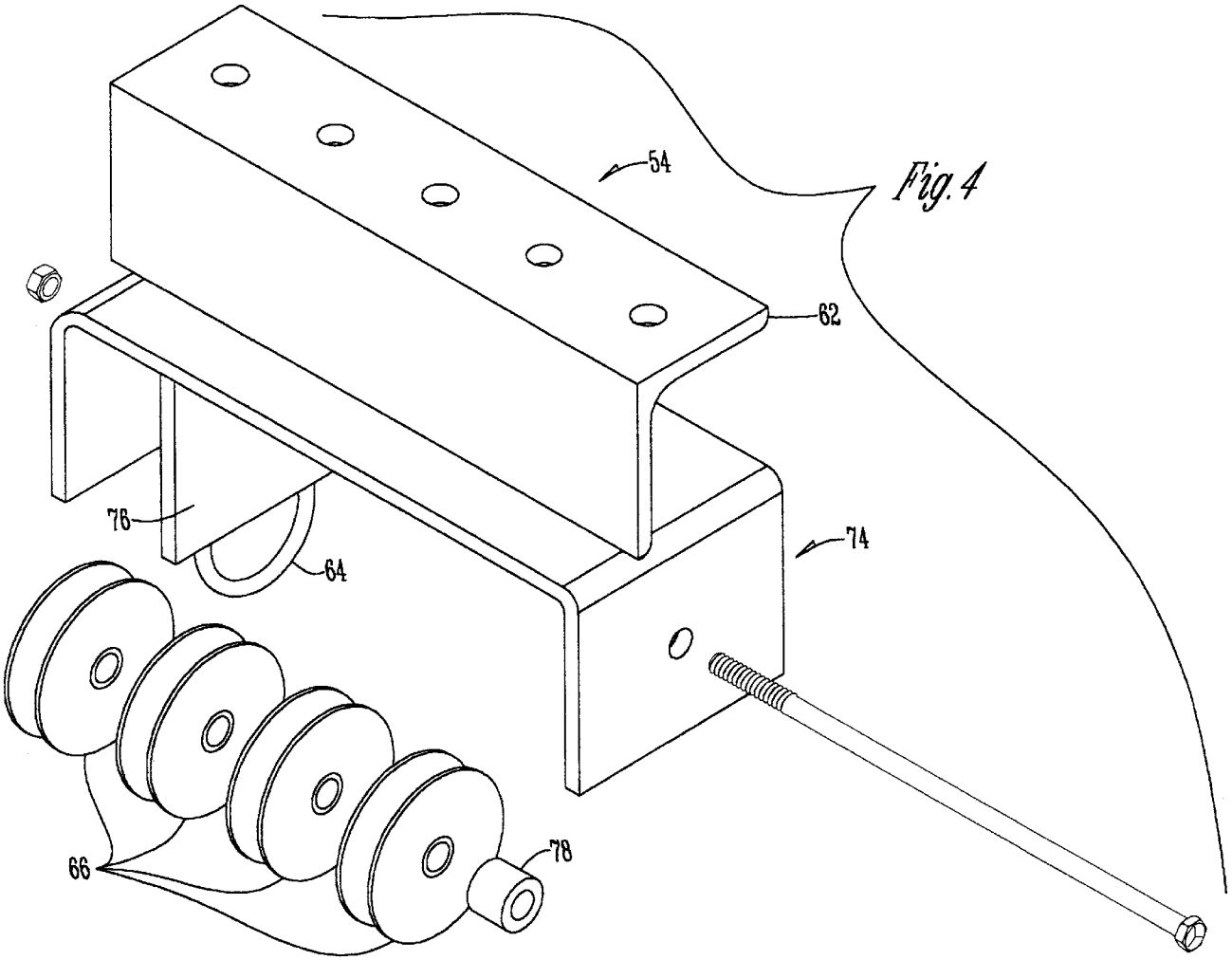
FIG. 4 is an exploded perspective view of a pulley assembly of the invention.

With reference to FIGS. 1, 3, and 4, each pulley assembly 54 includes a bracket 62 securing the pulley assembly 54 to the superstructure 12, a snaplink 64 engaging the pulley assembly 54 to the track 16, and a plurality of pulleys 66 where each pulley directs a single cord 52 from the wench 50 over the pulley 66 and to the screen 18.

The cords 52 are strung over the pulleys 66 in a step like manner. The first cord 68 is strung over the first pulley assembly 70 and down to the screen 18, while the second cord 72 is strung over the first pulley assembly 70 to the second pulley assembly 74 and down to the screen. In each instance, the cords 52 descend to the screen 18 over the pulley 66 located closest to a proximal end 76 of each pulley assembly 54. The second pulley assembly 74 receives one less cord 52 than the first pulley assembly 70. Accordingly, the second pulley assembly 74 includes a spacer 78 in place of one of the plurality of pulleys 66.

As the cords 52 descend form the pulleys 66, they are strung through vertical grommet rows 80 in the screen 18 and attached to a hinged batten 82 located in the lower end 40 of screen 18. When the screen 18 is in the lowered position, the hinged batten 82 acts to straiten and weigh down the lower end 40. When the screen is raised the hinged batten 82 flexes to conform the lower end 40 to the shape of the superstructure.

It is therefore seen that the present invention provides a divider curtain having a screen, which results in conforming to the shape of the superstructure when the screen is in a raised position.

It is therefore seen that this invention will accomplish at least all of its stated objectives.

We claim:

1. A divider curtain for attachment to a non-linear superstructure, comprising:

a screen having an upper end and lower end, the upper end is adapted to engage the non-linear superstructure and to conform to the shape thereof, the lower end having a straight horizontal edge when the screen is in a lowered position; and wherein the lower end is adapted to conform to the non-linear shape of the superstructure when the screen is in a raised position;

wherein the screen has a lateral dimension and a longitudinal dimension; and wherein the screen stretches an equal amount in the lateral and longitudinal dimensions when the screen is fully raised.

2. The divider curtain of claim 1, wherein the screen is composed of a non-stretchable material.

3. The divider curtain of claim 1, wherein the screen is adapted to contract in a lateral dimension as the screen is raised in a longitudinal dimension.

4. The divider curtain of claim 1, wherein the non-linear superstructure includes an inverted V-shaped configuration.

5. A divider curtain for attachment to a non-linear superstructure, comprising:

a plurality of trolleys having an upper portion and a lower portion, the upper portion adapted to be movably operatively associated with the non-linear superstructure;

a screen having an upper end and lower end, the upper end is adapted to conform to the shape of the non-linear superstructure, the lower end having a straight horizontal edge when the screen is in a lowered position, and wherein the screen upper end is attached to the lower portions of the trolleys; and wherein the lower end is adapted to conform to the shape of the non-linear superstructure when the screen is in a raised position.

6. The divider curtain of claim 5, wherein the trolleys are adapted to move in a lateral dimension as the screen is raised to allow the screen to contract in the lateral dimension as the screen is raised in a longitudinal dimension.

7. The divider curtain of claim 5, wherein the non-linear superstructure includes an inverted V-shaped configuration.

8. A divider curtain for attachment to a V-shaped superstructure, comprising:

a track adapted to engage the V-shaped superstructure and to conform to the shape of the V-shaped superstructure;

a plurality of trolleys having an upper portion and a lower portion, the upper portion being movably engaged with the track;

a screen having an upper end and lower end, the upper end is adapted to conform to the shape of the V-shaped superstructure, the lower end having a straight horizontal edge when the screen is in a lowered position, and wherein the upper end is attached to the lower portions of the trolleys; and wherein the lower end is adapted to conform to the shape of the V-shaped superstructure when the screen is in a raised position.

9. The divider curtain of claim 8, wherein the trolleys are adapted to move along the track as the screen is raised to allow the screen to contract in a lateral dimension as the screen is raised in a longitudinal dimension.

10. The divider curtain of claim 8, wherein the track has an upper surface, a lower surface, a proximal end, a distal end, and a mid point between the proximal and distal ends, wherein the upper surface is adapted to engage the V-shaped superstructure, the lower surface has an elongated opening for receiving the trolleys, and the proximal and distal ends slope downwardly from the mid point.

11. The divider curtain of claim 10, wherein the lower end of the screen has a proximal tip, a distal tip, and an inner point between the proximal and distal tips, and wherein the inner point raises a greater distance than the proximal and distal tips; and wherein the trolleys are adapted to move toward the track midpoint as the screen is raised.

12. The divider curtain of claim 11, wherein a distance between the screen inner point and the track mid point, a distance between screen distal tip and the track lower surface, and a distance between proximal tip of the screen and the lower surface of the track are all equal, when the screen is fully raised.

13. The divider curtain of claim 8, further comprising a wench operatively associated with the screen to raise and lower the screen, wherein the wench includes a drum assembly having a plurality of drum bracket of varying size.

14. The divider curtain of claim 13, wherein a plurality of cords are provided, a single cord being associated with a single drum bracket, each cord being operatively associated with the screen to raise and lower the screen when the wench is operated.

15. The divider curtain of claim 13, further comprising a plurality of pulley assemblies engaging the upper surface of the track to the V-shaped superstructure, wherein each pulley assembly includes at least one pulley associated with one cord, and wherein each cord extends from the wench over one pulley and is associated with the screen.

* * * * *